United States Patent [19]

Hahn, Jr. et al.

[11] 4,208,054

[45] Jun. 17, 1980

[54] GAME BOARD HAVING CONCENTRIC AND RADIAL MOVEMENT PATHS

[76] Inventors: W. James Hahn, Jr.; Jo A. Hahn, both of 4901 Vega Ct. West, Fort Worth, Tex. 76133

[21] Appl. No.: 877,999

[22] Filed: Feb. 15, 1978

[51] Int. Cl.[2] ..... A63F 3/00

[52] U.S. Cl. ..... 273/258

[58] Field of Search ..... 273/258, 262, 263

[56] References Cited

U.S. PATENT DOCUMENTS

| | | | |
|---|---|---|---|
| D. 120,643 | 5/1940 | Jones | 273/242 |
| 1,098,641 | 6/1914 | Robinson | 273/263 |
| 1,196,748 | 8/1916 | Smith | 273/242 |
| 2,733,066 | 1/1956 | Edwards | 273/258 |
| 3,190,655 | 6/1965 | Louie | 273/264 |
| 3,870,311 | 3/1975 | Klupp | 273/263 |
| 3,918,715 | 11/1975 | Puglis | 273/260 |

*Primary Examiner*—Vance Y. Hum
*Assistant Examiner*—R. Carl Moy
*Attorney, Agent, or Firm*—Richards, Harris and Medlock

[57] ABSTRACT

A board game includes player pieces of at least two types and a game board. The game board has a center area and player piece positions disposed in rows extending radially from the center area. Concentric movement paths connect the player piece positions of different rows and include first designations to indicate that any type of player piece may move along the concentric movement paths between the player piece positions. Radial movement paths connect player piece positions of the same row and include second designations to indicate that only one type of player piece may move along the radial movement path between two player positions. The second designations alternately mark the radial movement path between player piece positions such that any one type of the player pieces may move between only two player piece positions along the radial movement path before moving along a concentric movement path.

7 Claims, 1 Drawing Figure

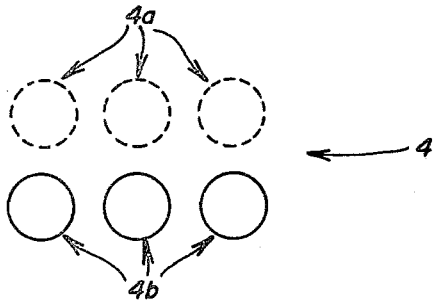
4a
4
4b
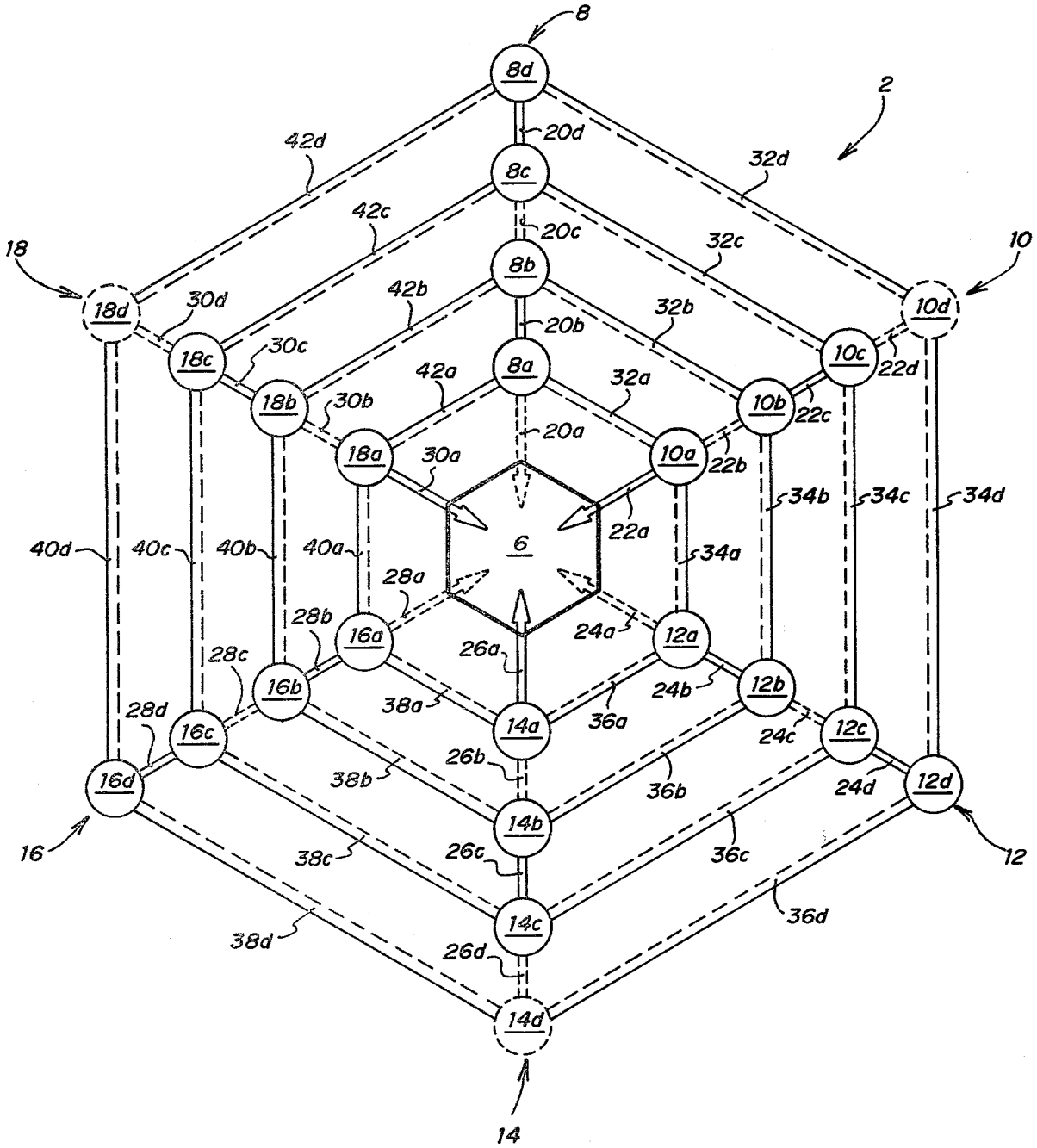
8
8d
2
20d
42d
8c
32d
42c
20c
32c
18
10
18d
30d
8b
42b
20b
32b
10d
18c
30c
10c
22d
8a
42a
32a
18b
30b
10b
22c
20a
18a
30a
10a
22b
34b
34c
34d
22a
6
40d
40c
40b
40a
34a
28a
28b
16a
24a
12a
26a
28c
16b
24b
12b
38a
36a
28d
16c
14a
24c
12c
26b
38b
36b
24d
16d
12d
14b
16
38c
26c
36c
12
14c
36d
38d
26d
14d
14

GAME BOARD HAVING CONCENTRIC AND RADIAL MOVEMENT PATHS

FIELD OF INVENTION

The present invention relates to board games and particularly relates to board games having a center area and player piece positions disposed in rows extending radially from the center area.

BACKGROUND AND SUMMARY OF INVENTION

Heretofore, board games have been developed having player piece positions disposed on a game board extending radially from a center area. Such game boards have been used in connection with one or more types of player pieces. However, the board games heretofore developed have been characterized by complex rules that make the game difficult for children to understand. Also, previously developed game boards using radially extending rows of player pieces have not utilized player movement paths that are designated to restrict the type of player pieces that may move along such movement paths.

In accordance with the present invention, a board game is provided having a plurality of player pieces of at least two types and a game board having a center area. Player piece positions are disposed in rows extending radially from the center area and the player piece positions are interconnected by movement paths. Concentric movement paths connect player piece positions of different rows and include first designations to indicate the type of player pieces that may move along the concentric movement path. Radial movement paths connect player piece positions of the same row and include second designations or indicia to indicate the type of player pieces that may move along the radial paths between player piece positions. The first and second designations or indicia of the concentric and radial movement paths, respectively, are used to restrict the movement of the player types to particular movement paths. Numerous combinations of movement path designations may be employed to restrict movement of the types of player pieces, but the movement paths should be designated such that the movement of each type of player piece is equally restricted.

The outer player piece positions along the outermost concentric movement path are designated to indicate starting positions of the various types of player pieces. Opponents in the game select one type of the player pieces and alternately move their pieces along the radial and concentric movement paths with the object of the game to be the first to move all of one's type of player pieces into the center area of the game board.

BRIEF DESCRIPTION OF THE DRAWINGS

The advantages and further aspects of the present invention will be readily appreciated by those of ordinary skill in the art as the same becomes better understood by reference to the following detailed description when considered in connection with the accompanying drawing in which a plan view of a game board is shown with player pieces represented as solid and dashed circles disposed adjacent the board.

DESCRIPTION OF THE PREFERRED EMBODIMENT

Referring now to the drawing there is shown a board game embodying the present invention. The game includes a game board 2 and player pieces 4 that are adapted to be placed and moved about on the board 2.

Board 2 includes a center area 6 and twenty-four player positions 8*a–d*, 10*a–d*; 12*a–d*, 14*a–d*; 16*a–d* and 18*a–d* which are arranged in six rows 8, 10, 12, 14, 16 and 18 extending radially from the center area 6. Row 8 is formed by player piece positions 8*a*, 8*b*, 8*c* and 8*d*. In like manner, the remaining rows 10–18 are formed by four player piece positions, each player piece of each row designated by reference characters in a manner similar to row 8.

Each of rows 8, 10, 12, 14, 16 and 18 form a 60 degree angle with adjacent rows such that the rows are spaced at equal angles about the center area 6. Alternate outermost player piece positions 10*d*, 14*d* and 18*d* are dashed and the remaining outermost player piece positions 8*d*, 12*d* and 16*d* are solid. These outermost player positions are the starting positions for player pieces 4 with dashed positions 10*d*, 14*d* and 18*d* indicating the starting positions for one side or type of player pieces, and the positions 8*d*, 12*d* and 16*d* indicating starting positions for the opposite side or type of player pieces.

Player piece positions within the same row are interconnected by radial movement paths. Radial movement path 20*d* is disposed between positions 8*d* and 8*c*; radial movement path 20*c* is disposed between positions 8*c* and 8*b*; radial movement path 20*b*; is disposed between positions 8*b* and 8*a*; and radial movement path 20*a* extends from position 8*a* to the center area 6. Radial movement paths 22*a–d*; 24*a–d*; 26*a–d*; 28*a–d*; and 30*a–d* are likewise disposed along rows 10, 12, 14, 16, and 18 of player piece positions, respectively. The radial movement paths are designated either as solid or dashed movement paths, and the designation of the radial movement path alternates along each row. Thus, in row 8 radial movement paths 20*d* and 20*b* are solid, and radial movement paths 20*c* and 20*a* are dashed. The radial movement paths in row 10 are also alternately designated along row 10 in an opposite sense from row 8. Radial movement paths 22*d* and 22*b* are dashed, and radial movement paths 22*c* and 22*a* are solid. In like manner, the remaining radial movement paths 24*a–d*, 266*a–d*; 28*a–d*; and 30*a–d*are alternately designated along rows 12, 14, 16 and 18, respectively, with the outermost radial path corresponding in designation to the outermost player piece position such that radial movement paths in rows 8, 12 and 16 are alternately designated in an opposite sense from rows 10, 14 and 18. Thus, radial movement paths 24*d*; 24*b*; 26*c*; 26*a*; 28*d*; 28*b*; 30*c* and 30*a* are solid while radial paths 24*c*; 24*a*; 26*d*; 26*b*; 28*c*; 28*a*; 30*d* and 30*b* are dashed.

The player piece positions in each row are connected to player piece positions in other rows by means of concentric movement paths. The outermost player piece positions 8*d*; 10*d*; 12*d*, 14*d*,16*d* and 18*d* are connected by concentric movement paths 32*d*, 34*d*, 36*d*, 38*d*, 40*d* and 42*d* forming a hexagonal configuration. In like manner, the remaining player piece positions 8*a–c*, 10*a–c*, 12*a–c*; 14*a–c*; 16*a–c* and 18*a–c* are interconnected by concentric movement paths 32*a–c*, 34*a–c*, 36*a–c*; 38*a–c*; 40*a–c*, and 42*a–c* to form concentric hexagonal configurations. Each concentric movement path is designated by both a solid and a dashed line.

The player pieces 4 are of two different types, dashed player pieces 4*a* and solid player pieces 4*b*. Each player selects one type of player pieces to move. To begin the game the solid player pieces of 4*b* are placed on the solid outermost player piece positions 8*d*, 12*d* and 16*d*, and the dashed player pieces 4*a* are placed on the outermost dashed player positions 10*d*, 14*d* and 18*d*. Next an arbitrary decision is made as to which type of piece should be moved first. This decision may be made by chance, such as by flipping a coin, or the rules of the game may arbitrarily designate the type of player pieces, 4*a* or 4*b*, that has the first move. After the first move, the players alternate turns moving their pieces.

Player pieces may be moved in any direction along any movement path that includes a designation corresponding to the particular player piece to be moved. In the preferred embodiment, all concentric movement paths include both dashed and solid lines. Thus, both player piece types 4*a* and 4*b* may move along any concentric path in both clockwise and counterclockwise directions. However, the radial movement paths include only one designation, either solid or dashed lines. According to the rules of the game, player pieces may move only along radial movement paths of corresponding designation. Thus, dashed player pieces 4*a* may only move along the dashed radial movement paths 20*a*; 20*c*, 22*b*, 22*d*, 24*a*; 24*c*; 26*b*, 26*d*, 28*a*, 28*c*; 30*b* and 30*d*, and solid player pieces 4*b* may only move along solid radial movement path 20*b*; 20*d*; 22*a*; 22*c*, 24*b*, 24*d*, 26*a*, 26*c*, 28*b*, 28*d*, 30*a* and 30*c*. Player pieces may move toward or away from the center area 6 along an appropriately designated radial movement path.

According to the rules of the game, no two player pieces may occupy the same player piece position. If a player piece has the proper movement path to a particular player piece position, but that position is occupied by another player piece, then the move is blocked. A move by a particular player piece may be blocked by the same or a different type of player piece.

The object of the game is to move all of one's player pieces into the center area 6. Thus, if one was playing with the dashed player pieces 4*a*, the object of the game would be to move all of the player pieces 4*a* into the area 6. If a player cannot move any of his pieces he loses the game, and the players may declare a "draw" if neither can move all of his pieces into the center. The players may play sets of games such as the best of three or the best of five, and when this procedure is followed, the players take turns moving first in the consecutive games.

As an example of how a player piece may be moved to the center area 6, consider a dashed player piece 4*a* that is started on the outermost player piece position 10*d*. One possible path to the center area 6 would be from position 10*d* along radial movement path 22*d* to position 10*c*; along concentric movement path 32*c* to position 8*c*, along radial movement path 20*c* to position 8*b*, along concentric movement path 32*b* to position 10*b*, along radial movement path 22*b* to position 10*a*; along concentric movement path 32*a* to position 8*a*, and along radial movement path 20*a* to the center area 6.

It will be understood that solid and dashed lines were used in the foregoing description to designate types of player pieces and outermost player piece positions and to designate movement paths along which a particular player piece may move. These designations may be accomplished by numerous methods. One method of making such designations is to provide different color schemes for player pieces 4*a* and 4*b* and to provide corresponding color scheme designations for concentric and radial movement paths and for the outermost player piece positions 8*d*, 10*d*, 12*d*, 14*d*, 16*d* and 18*d*. It will be understood that the scope of the present invention is not limited to any one particular method of designating different player positions, player types and the corresponding movement paths.

In the preferred embodiment, the game board 2 includes twenty-four player piece positions arranged in six rows of four positions each. It will be readily appreciated that any number of player piece positions may be provided in rows of greater or fewer number than six. It will be understood that the present invention is not limited to a particular number of player positions or a particular number of rows of player positions.

In the preferred embodiment, the concentric movement paths 32*a–d* through 42*a–d* were illustrated as straight lines. It will be readily appreciated that such concentric movement paths may also consist of curved lines such that the entire concentric movement path would be circular instead of hexagonal as illustrated. It will be understood that the present invention is not limited to concentric movement paths forming a particular geometric configuration.

Although a particular embodiment of the present invention has been described, it will be understood that the invention is not limited to the embodiments disclosed, but is capable of numerous rearrangements, modifications, and substitutions of parts and elements without departing from the spirit of the invention.

What is claimed is:

1. A board game comprising:

an equal number of two types of player pieces, each type of said pieces having a distinguishing indicia;

a center area disposed in the center of the game board;

player piece positions disposed in rows extending radially from said center area;

a plurality of concentric movement paths connecting said player piece positions, said paths having indicia identical to both types of indicia of said player pieces to provide an indication that said pieces may move in either direction along said concentric movement paths; and a plurality of radial movement paths connecting said player piece positions, said radial movement paths having first and second indicia each identical to one of said player piece indicia to provide an indication of which one type of player pieces may move along one of said radial movement paths such that said first and second indicia alternate between said player positions along a radial line, thereby allowing each player to move between only two radially connected said player positions before having to move along one of said concentric movement paths.

2. The board game of claim 1 wherein:

said concentric movement paths are concentric hexagons having six of said player piece positions located at the point where each of said rows bisect an angle of concentric hexagonal movement paths.

3. The board game of claim 1 wherein:

said radial movement paths have indicia for indicating a direction of said player pieces to move inwardly from one of said concentric movement paths to said center area.

4. A board game comprising:

a plurality of player pieces including at least two types of player pieces distinguished by different colors;

a game board having a center area;

player piece positions disposed in rows extending radially outward from said center area;

concentric movement paths connecting player piece positions of different rows and including first indicia to indicate that either type of player piece may move along said concentric movement paths, said first indicia being two color paths on said concentric movement paths, one of said path colors being identical to the color of one of said player pieces, and the other of said path colors being identical to the color of the other of said types of player pieces; and radial movement paths connecting said player piece positions along said rows and including second indicia to indicate that only one type of player piece position may move along said radial movement path between two of said player piece positions, said second indicia including alternate indicia between each of said player piece positions such that any one type of player pieces may move between only two of said player piece positions before having to move along one of said concentric movement paths, and said second indicia being single color paths on said radial movement paths with alternating colors between player piece positions along said radial movement paths.

5. The board game of claim 4 wherein:

said concentric movement paths are concentric hexagons and said player pieces are three pieces of a first color and three pieces of a second color.

6. The board game of claim 5 wherein:

the outermost one of said hexagonal concentric movement paths has six player piece positions located where each of said radial movement paths bisect the angles of said hexagons, and said player piece positions are alternately colored to be identical to the color of said player pieces.

7. The board game of claim 4 wherein:

said player pieces are identical in number to the number of said player positions around each one of said concentric movement paths.

* * * * *